US007857593B2

(12) United States Patent
Garin et al.

(10) Patent No.: US 7,857,593 B2
(45) Date of Patent: Dec. 28, 2010

(54) RETAINING DEVICE FOR AXIALLY RETAINING A ROTOR DISK FLANGE IN A TURBOMACHINE

(75) Inventors: Fabrice Garin, Yerres (FR); Maurice Guy Judet, Dammarie les Lys (FR); Thomas Langevin, Dammarie les Lys (FR)

(73) Assignee: SNECMA, Paris (FR)

( * ) Notice: Subject to any disclaimer, the term of this patent is extended or adjusted under 35 U.S.C. 154(b) by 935 days.

(21) Appl. No.: 11/697,450

(22) Filed: Apr. 6, 2007

(65) Prior Publication Data

US 2007/0237645 A1 Oct. 11, 2007

(30) Foreign Application Priority Data

Apr. 10, 2006 (FR) ..... 06 51286

(51) Int. Cl.
*F04D 29/34* (2006.01)

(52) U.S. Cl. ..... 416/220 R

(58) Field of Classification Search ..... 415/199.5; 416/220 R

See application file for complete search history.

(56) References Cited

U.S. PATENT DOCUMENTS 4,304,523 A 12/1981 Corsmeier et al.
5,622,475 A * 4/1997 Hayner et al. ..... 416/220 R
7,217,100 B2 * 5/2007 Benderradji et al. ..... 416/221

FOREIGN PATENT DOCUMENTS

EP 0 921 272 B1 9/2003
EP 1 498 579 A1 1/2005

* cited by examiner

*Primary Examiner*—Edward Look
*Assistant Examiner*—Ryan H Ellis
(74) *Attorney, Agent, or Firm*—Oblon, Spivak, McClelland, Maier & Neustadt, L.L.P.

(57) ABSTRACT

A retention device for axially retaining a rotor disk flange, the device including a split annular retaining ring. The ring has an external face bearing against an internal face of the rim, thereby resulting in a first axial force, an internal face bearing against an external face of the root, thereby resulting in a second axial force, the axial forces being radially offset relative to each other, and an outer face bearing against an inner face of the base of the flange, thereby resulting in a radial force. The outer face of the ring presents an annular setback in such a manner that the radial force is situated in a plane that is offset axially relative to a radial plane passing through the center of gravity of the ring so as to obtain mechanical equilibrium between the forces acting on the ring.

8 Claims, 2 Drawing Sheets

RETAINING DEVICE FOR AXIALLY RETAINING A ROTOR DISK FLANGE IN A TURBOMACHINE

BACKGROUND OF THE INVENTION

The present invention relates to a retaining device for axially retaining an annular flange against a radial face of a turbomachine rotor disk.

More precisely, the invention relates to an improvement to the retaining device described in patent application EP 1 498 579 A1 filed by the Applicant. Such a device enables an annular flange to be retained against a radial face of a rotor disk, said disk presenting in the radial face an annular recess that is defined by a plurality of walls, one of which is formed by the internal face of a rim that extends radially outwards, said flange presenting in its radially inner portion an annular base that bears against the radially outer wall of the recess, and a root extending from the base radially inwards into the recess of the disk. According to that invention, the retaining device further comprises a retaining ring constituted by a split ring disposed in the recess of the rotor disk, the retaining ring having an axially external face that bears against an axially internal face of the rim, an axially internal face that bears against an axially external face of the root, and a radially outer face that bears against a radially inner face of the base of the flange.

That retaining device, and in particular the retaining ring, is simple to make, inexpensive, and makes it easier to mount and remove the parts. Nevertheless, it presents certain drawbacks. In particular, in operation, the flange is subjected to axial thrust that runs the risk of tilting the retaining ring outwards from the recess in the rotor disk. Such tilting of the retaining ring can then lead to hammering wear of the rotor disk, with a risk of it bursting. The tilting of the retaining ring can also lead, after hammering wear, to it becoming disengaged from the recess and thus leading to the flange escaping from its housing.

OBJECT AND SUMMARY OF THE INVENTION

A main object of the present invention is thus to mitigate such drawbacks by proposing a retaining device for axially retaining a rotor disk flange that makes it possible to avoid any risk of the retaining ring tilting.

This object is achieved by a retaining device in which the split annular retaining ring that is placed in the recess in the rotor disk has an axially external face that bears against an axially internal face of the rim, thereby resulting in a first axial force acting in a substantially axial direction, an axially internal face that bears against an axially external face of the root, thereby resulting in a second axial force acting in a direction that is substantially axial and opposite to the first axial force, the axial forces being radially offset relative to each other, and a radially outer face that bears against a radially inner face of the base of the flange, thereby resulting in a radial force acting in a substantially radial direction, and in which, in accordance with the invention, the radially outer face of the retaining ring presents an annular setback such that the radial force that results from said face bearing against the radially inner face of the base of the flange is situated in a plane that is offset axially relative to a radial plane passing through the center of gravity of the retaining ring so as to obtain mechanical equilibrium between the forces acting on said retaining ring.

The axial forces that act on the retaining ring are due to the flange being mounted with prestress on the rotor disk. The radial offset between these forces comes from the fact that it is necessary to pass the root of the flange over the rim of the disk both during mounting and during removal of the flange. The radial force that acts on the radially outer face of the ring comes from the centrifugal force that results from rotation of the rotor disk. By making an annular setback in the radially outer face of the retaining ring, it is possible to offset axially the direction of the radial force acting on said face so as to compensate for the torque created by the radial offset between the axial forces. As a result, it is possible to obtain mechanical equilibrium between the forces acting on the various faces of the retaining ring, thereby preventing it from tilting in operation.

The radial force that results from the radially outer face of the retaining ring bearing against the radially inner face of the base of the flange lies in a radial plane that is preferably located between the axially external and internal faces of the retaining ring.

When the second axial force resulting from the axially internal face of the ring bearing against the axially external face of the root is offset radially outwards relative to the first axial force resulting from the axially external face of the ring bearing against the axially internal face of the flange, then the annular setback in the radially outer face of the retaining ring is advantageously disposed in such a manner that the radial force is situated in a plane that is radially offset towards the internal face of the ring relative to the radial plane passing through the center of gravity of the ring.

Preferably, a radially inner portion of the retaining ring is received in a groove formed behind the rim of the rotor disk.

The invention also provides a turbine and a turbomachine including at least one retaining device as defined above.

BRIEF DESCRIPTION OF THE DRAWINGS

Other characteristics and advantages of the present invention appear from the following description made with reference to the accompanying drawings that show an embodiment having no limiting character. In the figures.

DETAILED DESCRIPTION OF AN EMBODIMENT

Figure 1:
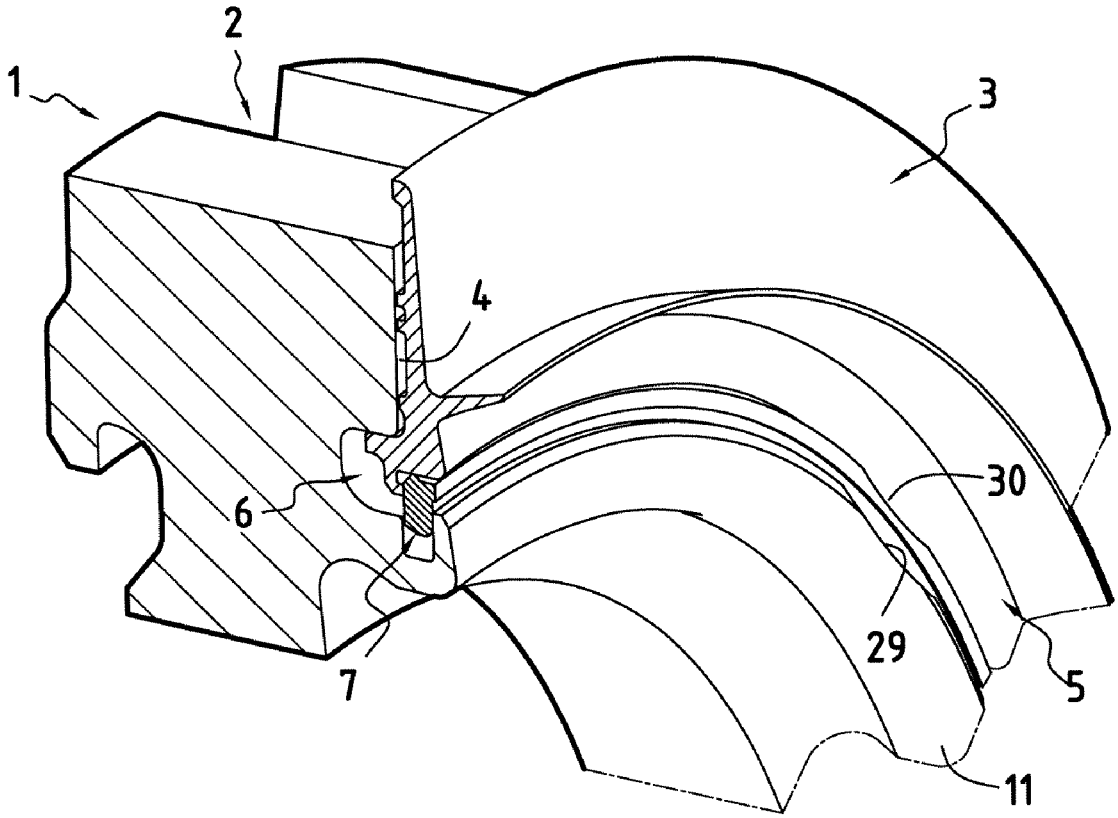
FIG. 1 is a fragmentary perspective view of a device of the invention for retaining a turbomachine rotor disk flange.

The figures show a fragment of a turbomachine disk 1, e.g. a rotor disk of a high pressure turbine.

The disk 1 includes a plurality of substantially axial slots 2 each intended to receive the root of a blade (not shown). An annular flange 3 mounted against a face 4 of the disk serves to prevent the blades from moving axially relative to the disk. A radially inner portion 5 of the flange 3 is received in an annular recess 6 formed in the face 4 of the disk and it is held therein by a retaining ring that is in the form of a split ring 7.

In the description below, the terms "inner" and "outer" designate a wall or a face respectively closer to or further from the axis of rotation of the disk 1, while the terms "internal" and "external" refer to a wall or a face that is respectively closer to or further from the midplane of the disk.

Figure 2:
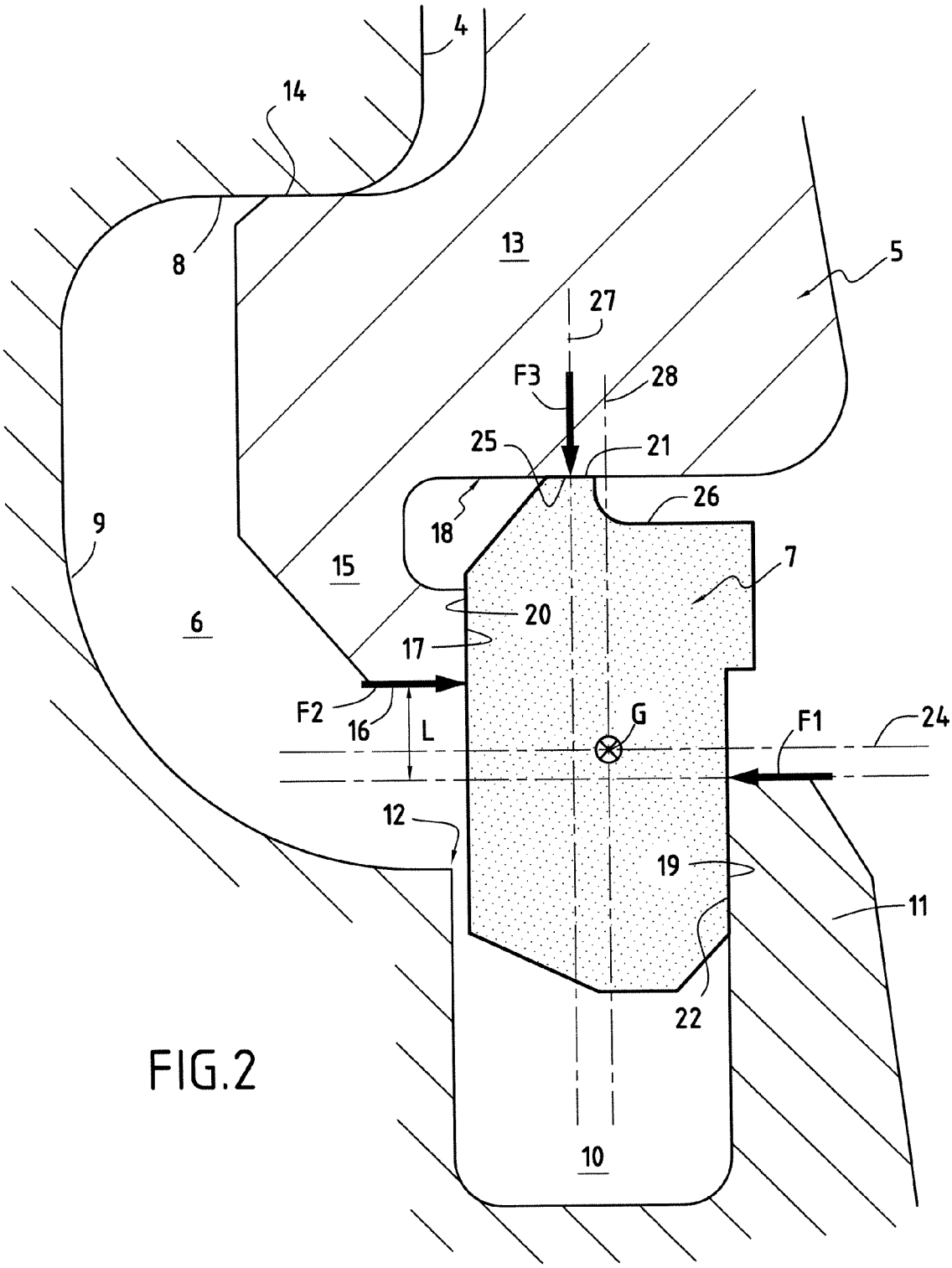
FIG. 2 is a fragmentary view of the FIG. 1 device in section on a plane containing the axis of rotation of the rotor disk.

As shown in FIG. 2, the annular recess 6 is defined radially outwardly by a wall 8 that is substantially cylindrical and that is connected by a concave surface 9 to an annular groove 10 of channel-section that is disposed behind an annular rim 11 of the disk. The rim 11 extends radially outwards and presents a diameter that is slightly greater than the diameter of the shoulder 12 formed between the concave surface 9 and the bottom of the groove 10.

In the example shown in the figures, the groove 10 and the rim 11 emerge from the face 4 of the disk 1. Nevertheless this configuration is not essential for implementing the invention.

The radially inner portion 5 of the flange 3 has an annular base 13 that extends into the recess 6 of the disk and that presents an outer surface 14 that is cylindrical and that bears against the cylindrical wall 8 of the disk.

The radially inner portion 5 of the flange 3 also has a root 15 that is located under the base 13 and that extends radially inwards. In order to enable the radially inner portion 5 of the flange 3 to be inserted into the recess 6 during assembly or in order to enable it to be disassembled, the bore diameter 16 of the root 15 is substantially equal to or slightly greater than the outside diameter of the rim 11.

The root 15 of the radially inner portion 5 of the flange 3 presents an axially external face 17 that lies in a radial plane passing through the groove 10 in the vicinity of the shoulder 12. This external face 17 is connected to the radially inner face 25 of the base 13 and co-operates therewith to form a rabbet 18.

The retaining ring 7 is disposed in the recess 6 in such a manner that its radially outer portion is received in the rabbet 18 and its radially inner portion is received in part in the groove 10.

The retaining ring 7 presents a right section that is substantially rectangular. It has two mutually parallel axial faces that are perpendicular to the axis of rotation of the disk 1, i.e. an axially external face 19 and an axially internal face 20. In addition, in its radially outer portion received in the rabbet 18, the retaining ring presents a radially outer face 21.

As shown in FIG. 2, the axially external face 19 of the retaining ring 7 bears against an axially internal face 22 of the rim 11. This axial contact is the result of a reaction force whose resultant is represented by arrow F1. This axial force F1 extends in a substantially axial direction and is directed internally.

Similarly, the axially internal face 20 of the retaining ring 7 bears against the axially external face 17 of the root 15 of the flange 3, and the resulting reaction force is represented by arrow F2. This other axial force F2 acts in a direction that is substantially axial and opposite to that of the axial force F1, i.e. it is externally directed.

As explained below, the axial forces F1, F2 acting on the axial faces of the ring 7 are due to the flange 3 being mounted with prestress against the axial face 4 of the disk 1.

Because of the particular disposition of the various elements of the retaining device made necessary for enabling the flange to be mounted and removed, it should be observed that the axial force F1 is offset radially outwards relative to the other axial force F2 (this radial offset being represented by the length L in FIG. 2). Without such a radial offset L, it would be impossible to pass the root 15 of the flange 3 over the rim 11 when mounting or removing said flange.

It should also be observed that the axial forces F1 and F2 bear against the axial faces 19, 20 of the retaining ring 7 along lines that are disposed radially on either side of an axial geometrical construction line 24 passing through the center of gravity of the ring as represented by a point G in FIG. 2.

The radially outer face 21 of the retaining ring 7 bears against the radially inner face 25 of the base 13 of the flange 3 (this face 25 is formed in the rabbet 18). This radial contact delivers a reaction force having a resultant represented by arrow F3 in FIG. 2. This radial force F3 acts in a substantially radial direction that is directed inwards and that is due to the centrifugal force that results from the disk 1 rotating about its axis.

It should be observed that because of the shape of the retaining ring 7 and because of its particular disposition relative to the flange 3 and to the rim 11 on the disk, the radial force F3 preferably acts in a radial plane that lies between the two parallel axial faces 19 and 20 of the retaining ring.

Because of the radial offset that exists between the axial forces F1 and F2 acting on the axial faces 19 and 20 of the retaining ring 7, and because of the way they are distributed about the axial line 24 passing through the center of gravity G of the retaining ring, there is a risk of the retaining ring tilting about its center of gravity.

In order to avoid that risk, provision is made in accordance with the invention for the radially outer face 21 of the retaining ring 7 to present an annular setback (or draft) 26 such that the radial force F3 that results from said face 21 bearing against the radially inner face 25 of the base 13 lies in a plane 27 that is offset axially relative to a radial plane 28 passing through the center of gravity G of the retaining ring.

By adjusting the position of the contact surface between the radially outer face 21 of the retaining ring 7 and the radially inner face 25 of the base 13, it is thus possible to obtain mechanical balancing between the forces F1 to F3 acting on the retaining ring. This adjustment is achieved by making an annular setback 26 of greater or lesser depth (in the axial direction) in the radially outer face 21 of the retaining ring 7.

As shown in FIG. 2, when the axial force F2 is offset radially outwards relative to the axial force F1, the annular cutout 26 is made in such a manner that the radial force F3 lies in a plane 27 that is offset axially towards the axially internal face 20 of the retaining ring 7 relative to the radial plane 28 passing through the center of gravity G of the retaining ring. This enables mechanical equilibrium to be established between the forces F1 to F3 bearing on the retaining ring.

Naturally, in an opposite situation, i.e. if the axial force F2 were offset radially inwards relative to the axial force F1, then the annular cutout would be made in such a manner that the radial force F3 lies in a plane offset axially towards the axially external face 19 of the retaining ring relative to the radial plane 28 thereof, likewise for the purpose of establishing mechanical equilibrium between the forces F1 to F3 acting on the retaining ring.

It should be observed that the presence of such an annular cutout 26 on the radially outer face 21 of the retaining ring 7 presents another advantage, namely that of making it possible to check that the retaining ring is properly positioned after assembly of the flange by passing a feeler into the cutout.

It should also be observed that the flange 3 is mounted and removed in the same manner as in the retaining device described in publication EP 1 498 579 A1.

Briefly, during mounting or removal of the flange, the retaining ring 7 is retracted into the groove 10 using compression tools. For this purpose, and as can be seen in FIG. 1, the rim 11 and the retaining ring 7 present a plurality of matching notches (29 in the rim 11 and 30 in the retaining ring) where the claws of the compression tools are placed.

Before putting the flange 3 into place, the retaining ring 7 is put into the recess 6, with its radially inner portion preferably being received in the groove 10. Using compression tools, the retaining ring 7 is retracted into the groove 10, and then the flange 3 is moved into place, causing its root 15 to pass over the rim 11, the retaining ring 7, and the claws. The flange 3 is then pressed against the axial face 4 of the disk 1 by applying axial pressure thereto. The retaining ring 7 is then expanded so that its radially outer face 21 comes to bear against the base 13. Finally, the axial pressure exerted on the flange 3 is removed and the retaining ring 7 is then compressed between the root 15 and the rim 11 (this compression giving rise to the axial forces F1 and F2 shown in FIG. 2). The flange is removed by the same process in reverse.

What is claimed is:

1. A device for axially retaining a flange of a rotor disk, the device comprising:

a rotor disk having a radial face that presents an annular recess defined by a plurality of walls, one of which is formed by the internal face of a rim that extends radially outwards;

an annular flange presenting, in its radially inner portion, an annular base pressing against the radially outer wall of the recess, and a root that extends from the base radially inwards into the recess of the disk; and a split annular retaining ring disposed in the recess of the rotor disk, the ring having an axially external face that bears against an axially internal face of the rim, thereby resulting in a first axial force acting in a substantially axial direction, an axially internal face that bears against an axially external face of the root, thereby resulting in a second axial force acting in a direction that is substantially axial and opposite to the first axial force, the axial forces being radially offset relative to each other, and a radially outer face that bears against a radially inner face of the base of the flange, thereby resulting in a radial force acting in a substantially radial direction;

wherein the radially outer face of the retaining ring presents an annular setback such that the radial force that results from said face bearing against the radially inner face of the base of the flange is situated in a plane that is offset axially relative to a radial plane passing through the center of gravity of the retaining ring so as to obtain mechanical equilibrium between the forces acting on said retaining ring; and wherein said split annular retaining ring presents a right section that is substantially rectangular.

2. A device according to claim 1, wherein the radial force that results from the radially outer face of the retaining ring bearing against the radially inner face of the base of the flange lies in a radial plane that is located between the axially external and internal faces of the retaining ring.

3. A device according to claim 1, wherein the annular setback in the radially outer face of the retaining ring is disposed in such a manner that the radial force lies in a plane that is radially offset towards the internal face of the ring relative to the radial plane passing through the center of gravity of the ring when the second axial force that results from the axially internal face of the ring bearing against the axially external face of the root is offset radially outwards relative to the first axial force that results from the axially external face of the ring bearing against the axially internal face of the rim.

4. A device according to claim 1, wherein a radially inner portion of the retaining ring is received in a groove formed behind the rim of the rotor disk.

5. A turbomachine turbine including at least one retention device according to claim 1.

6. A turbomachine including at least one retention device according to claim 1.

7. A device according to claim 1, wherein the annular setback of the retaining ring communicates with the axially external face of the retaining ring.

8. A device according to claim 7, wherein said annular setback is configured to receive a feeler after assembly of said retaining ring in order to check if the retaining ring is properly positioned.

* * * * *